US005090690A

United States Patent [19]

Huang

[11] Patent Number: 5,090,690

[45] Date of Patent: Feb. 25, 1992

[54] EXERCISE MECHANISM

[76] Inventor: Kelvin Huang, No. 210, Mingshan St., Homin Tsun, Hsiushui Hsiang, Changhua Hsien, Taiwan

[21] Appl. No.: 757,472

[22] Filed: Sep. 10, 1991

[51] Int. Cl.[5] ..... A63B 23/04

[52] U.S. Cl. ..... 272/70; 272/126

[58] Field of Search ..... 272/69, 70, 71, 73, 272/93, 126, 130

[56] References Cited

U.S. PATENT DOCUMENTS

| | | | |
|---|---|---|---|
| 3,970,302 | 7/1976 | McFee | 272/130 |
| 4,830,362 | 5/1989 | Bull | 272/70 |
| 4,838,543 | 6/1989 | Armstrong et al. | 272/70 |

OTHER PUBLICATIONS

Versa Climber Brochure 3001 Redhill Ave., Suite 106, Costa Mesa, Calif. 92626, 2 pages.

*Primary Examiner*—Stephen R. Crow

[57] ABSTRACT

An exerciser including a post extended upward from a base and having a pair of handles slidably disposed in the upper portion, a pair of pedals pivotally mounted at one end on the base, a pulley rotatably disposed in top of the post, two pulleys disposed in the post and each coupled to a pedal, second pedal, a cable having two ends fixed to the side walls of the post and extended over the pulleys and coupled to the handles so that the pedals and the handles are caused to move in concert.

4 Claims, 3 Drawing Sheets

EXERCISE MECHANISM

BACKGROUND OF THE INVENTION

1. Field of the Invention

The present invention relates to an exercise mechanism, and more particularly to an exercise mechanism designed to simulate climbing up a cliff and the like.

2. Description of the Prior Art

Exercise equipment designed to simulate climbing has long been known. U.S. Pat. No. 4,838,543 to Armstrong et al. discloses an exercise equipment designed to simulate climbing or jogging while eliminating shock impacts to the user's joint. However, the equipment is provided for exercising lower body muscle groups only.

Recently, climbing up a cliff, a steep hill or the like has become more and more popular. The present invention has arisen to provide a novel exercise mechanism for simulating climbing a steep hill.

SUMMARY OF THE INVENTION

The primary objective of the present invention is to provide an exercise mechanism for simulating climbing up a steep hill.

In accordance with one aspect of the invention, there is provided an exercise mechanism including a support frame including a base, a post extended upward from the base and including two side walls, a stay extended upward from the base to interconnect with the post at a point between its ends, the post including a slot formed in a lower portion of each of the side walls and a groove formed in an upper portion of each of the side walls; a pair of foot pedals pivotally mounted at one end on the stay at a location above the base, each of the foot pedals including a shaft extended through the slot into the post; a handle slidable along each of the grooves and having one end located in the post; resistance means interconnected between the foot pedals and a location on the support frame above the foot pedals; a first pulley rotatably disposed in top of the post, a second pulley and a third pulley provided in the post; a rope coupled between the second pulley and the shaft fixed to a first foot pedal; a cord coupled between the third pulley and the shaft fixed to a second foot pedal; a cable having one end fixed to a first side wall and extended downward and over the second pulley, extended upward and fixed to a first handle, extended upward and over the first pulley, extended downward and fixed to a second handle, extended downward and over the third pulley, extended upward and having the other end fixed to a second side wall of the post; the first foot pedal being caused to move upward when the second handle is pulled downward and when the second foot pedal is pressed downward, and the second foot pedal being caused to move upward when the first handle is pulled downward and when the first foot pedal is pressed downward.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
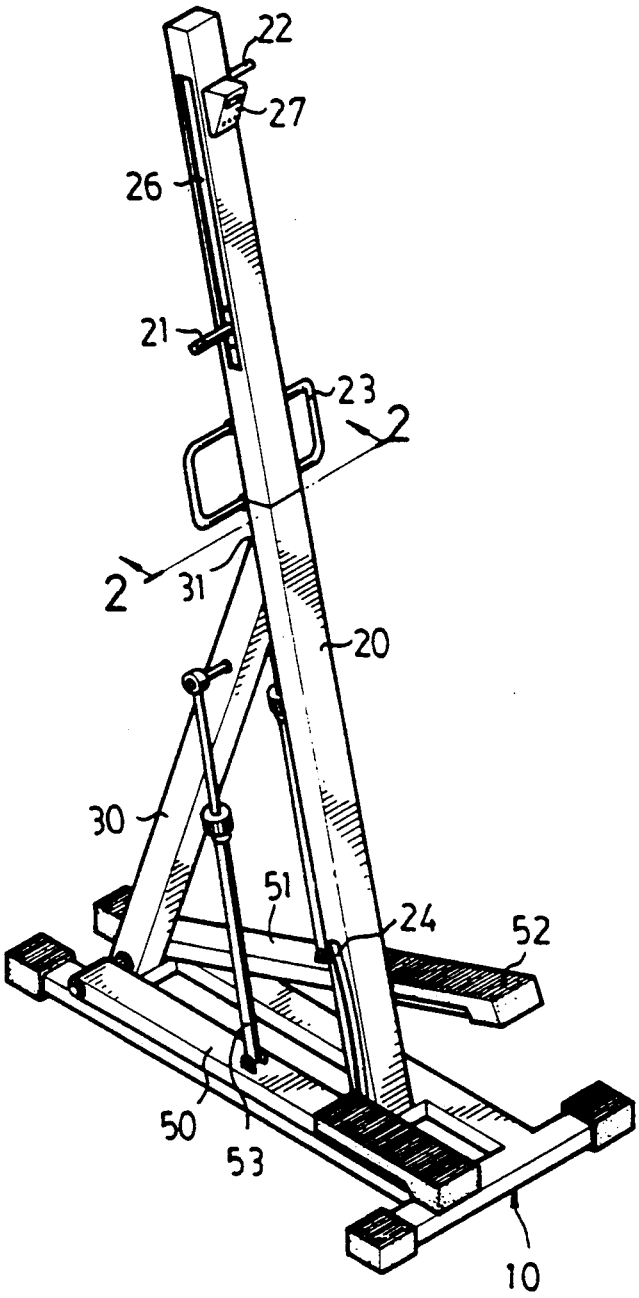
FIG. 1 is a perspective view of an exercise mechanism in accordance with the present invention.
Figure 2:
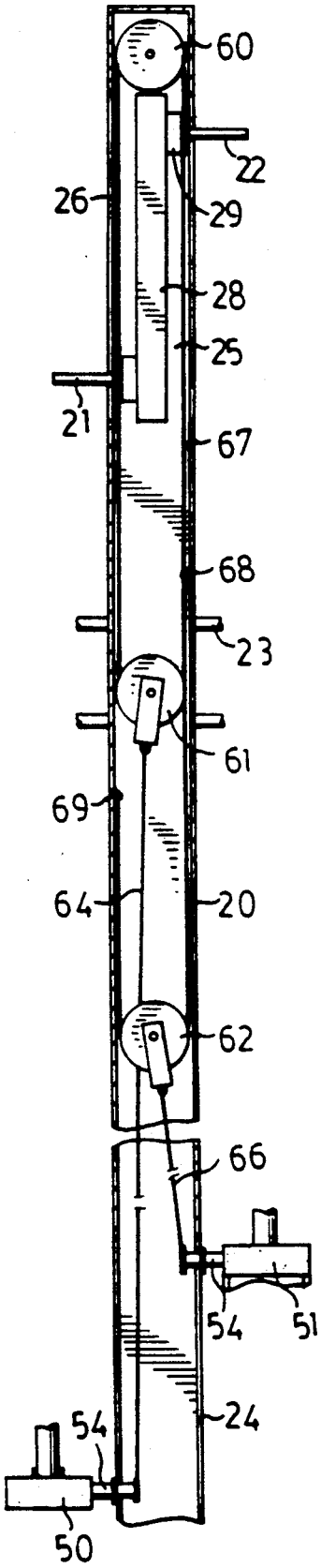
FIG. 2 is a cross sectional view taken along lines 2—2 of FIG. 1.

Referring to the drawings and initially to FIGS. 1 and 2, an exercise mechanism in accordance with the present invention comprises generally a base 10, a post 20 upwardly extended from the base 10 and slightly inclined relative to a vertical axis which is vertical and perpendicular to the base 10, a stay 30 extended upwards from the base 10 to intersect post 20 at a point 31 between its upper and lower ends, a pair of foot pedals 50, 51 having a first end pivotally coupled to the lower portion of the stay 30 and having a nonskid foot pad 52 disposed on the second end thereof, a resistance means 53, such as a cylinder disposed between each of the foot pedals 50, 51 and a point on the upper portion of the stay 30, and a pair of handles 21, 22 slidably disposed on the upper portion of the post 20 and coupled to the foot pedals 50, 51 so that the handles 21, 22 and the foot pedals 50, 51 move in concert in order to simulate climbing up a cliff and the like.

The post 20 includes a handgrip 23 disposed on the middle portion thereof and preferably disposed above the point 31, a pair of slots 24 formed in the lower portion of the side portions of the post 20, the slots being curved, and a pair of grooves 26 formed in the upper portion of the side portions of the post 20 through which the handles 21, 22 are extended. A counter or a displayer means 27 may be disposed on the upper portion of the post 20. Each of the foot pedals 50, 51 includes a shaft 54 laterally extended therefrom and extended into the lower portion of the post 20 through the respective slot 24. A rib 28 is formed in the upper portion of the post 20. Each of the handles 21, 22 has a block 29 fixed in the inner end thereof and located within the post 20 and slidably contacted with the rib 28 and arranged such that the blocks 29 are guided to move up and down along the spaces 25 defined by the rib 28 and the walls of the upper portion of the post 20 respectively.

As shown in FIG. 2, a first pulley 60 is rotatably disposed in the upper portion of the post 20, a second pulley 61 and a third pulley 62 are provided in the post 20, in which the second pulley 61 is located above the third pulley 62. A rope 64 is coupled between the second pulley 61 and the shaft 54 fixed to the left foot pedal 50. A cord 66 is coupled between the third pulley 62 and the shaft 54 fixed to the right foot pedal 51. A cable 67 has one end fixed to one side of the post 20 at a point 68, the cable 67 then extends downward and over the lower portion of the second pulley 61, then extends upward, fixes to the left handle 21, extends upward and over the upper portion of the first pulley 60, extends downward, fixes to the right handle 22, extends downward and over the lower portion of the third pulley 62, and then extends upward and has the other end fixed to the other side of the post 20 at a point 69.

Figure 3:
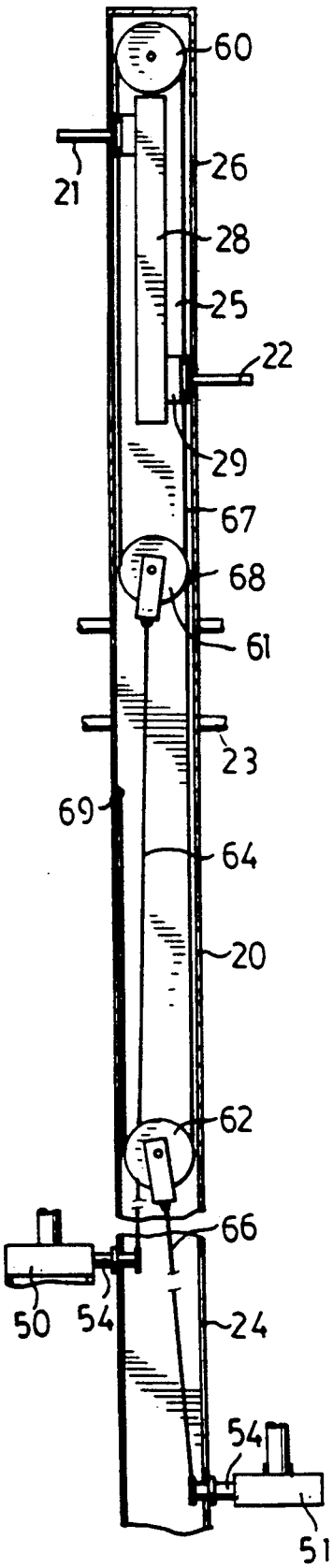
FIG. 3 is a cross sectional view similar to FIG. 2 illustrating the operation of the exercise mechanism.

In operation, as shown in FIG. 2, when the right pedal 51 is pressed downward by the user, the third pulley 62 is pulled downward so that the right handle 22 is pulled downward and so that the left handle 21 is caused to move upward, simultaneously, the second pulley 61 is caused to move upward so that the left pedal 50 is caused to move upward and so that the handles 21, 22 and the pedals 50, 51 can be caused to move to the position as shown in FIG. 3. In this case, the left handle 21 moves upward when the left pedal 51 moves upward, and moves downward when the left pedal 51 moves downward.

Figure 4:
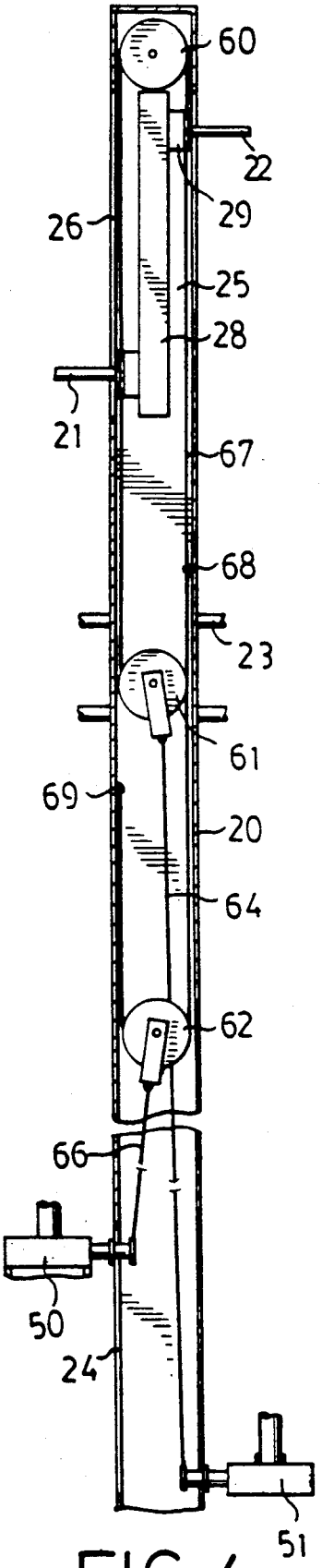
FIGS. 4 and 5 are cross sectional views similar to FIGS. 2 and 3, illustrating another embodiment of the present invention.
Figure 5:
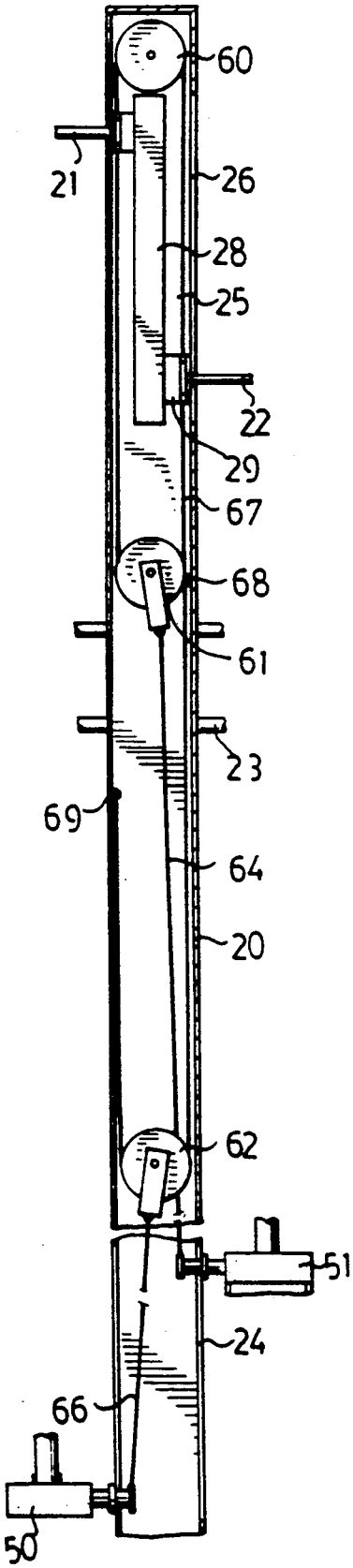

Referring next to FIGS. 4 and 5, illustrated is another embodiment of the present invention. In this embodiment, the rope 64 is coupled between the second pulley 61 and the right pedal 51, the cord 66 is coupled between the third pulley 62 and the left pedal 50. When the left pedal 50 moves downward, the right handle 22 is caused to move downward, the left handle 21 is caused to move upward and the right pedal 51 is caused to move upward. Accordingly, the left handle 22 moves upward when the left pedal 50 moves downward; i.e., the left handle 22 and the left pedal 50 move in reverse direction.

Accordingly, the exercise mechanism in accordance with the present invention is capable of simulating the exercise of climbing up a steep hill.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism comprising a support frame including a base, a post extended upward from said base and including two side walls, a stay extended upward from said base to interconnect with said post at a point between its ends, said post including a slot formed in a lower portion of each of said side walls thereof and a groove formed in an upper portion of each of said side walls thereof; a pair of laterally adjacent foot pedals pivotally mounted at one end on said stay at a location above said base, each of said foot pedals including a shaft fixed thereto and extended through a respective slot of said post and extended into said post; a handle slidable along each of said grooves and having one end located in said post; resistance means interconnected between said foot pedals and a location on said support frame above said foot pedals; a first pulley rotatably disposed in top of said post, a second pulley and a third pulley provided in said post, in which said second pulley being located above said third pulley; a rope coupled between said second pulley and said shaft fixed to a first foot pedal; a cord coupled between said third pulley and said shaft fixed to a second foot pedal; a cable having one end fixed to a first side wall and extended downward and over said second pulley, extended upward and fixed to a first handle, extended upward and over said first pulley, extended downward and fixed to a second handle, extended downward and over said third pulley, extended upward and having the other end fixed to a second side wall of said post; said first foot pedal being caused to move upward when said second handle is pulled downward and when said second foot pedal is pressed downward, and said second foot pedal being caused to move upward when said first handle is pulled downward and when said first foot pedal is pressed downward.

2. An exercise mechanism according to claim 1, wherein a rib is longitudinally formed in an upper portion of said post and located below said first pulley such that a space is formed between said rib and each of said side walls of said post, each of said handles includes a block fixed to said one end thereof and slidable along a respective space formed between said rib and said side walls of said post so that said handles can be guided to move up and down along said spaces.

3. An exercise mechanism comprising a support frame including a base, a post extended upward from said base and including two side walls, a stay extended upward from said base to interconnect with said post at a point between its ends, said post including a slot formed in a lower portion of each of said side walls thereof and a groove formed in an upper portion of each of said side walls thereof; a pair of laterally adjacent foot pedals pivotally mounted at one end on said stay at a location above said base, each of said foot pedals including a shaft fixed thereto and extended through a respective slot of said post and extended into said post; a handle slidable along each of said grooves and having one end located in said post; resistance means interconnected between said foot pedals and a location on said support frame above said foot pedals; a first pulley rotatably disposed in top of said post, a second pulley and a third pulley provided in said post, in which said second pulley being located above said third pulley; a cord coupled between said third pulley and a first foot pedal; a rope coupled between said second pulley and a second foot pedal; a cable having one end fixed to a first side wall of said post and extended downward and over said second pulley, extended upward and fixed to a first handle, extended upward and over said first pulley, extended downward and fixed to a second handle, extended downward and over said third pulley, extended upward and having the other end fixed to a second side wall of said post; said second foot pedal being caused to move upward when said second handle is pulled downward and when said first foot pedal is pressed downward, and said first foot pedal being caused to move upward when said first handle is pulled downward and when said second foot pedal is pressed downward.

4. An exercise mechanism according to claim 3, wherein a rib is longitudinally formed in an upper portion of said post and located below said first pulley such that a space is formed between said rib and each of said side walls of said post, each of said handles includes a block fixed to said one end thereof and slidable along a respective space formed between said rib and said side walls of said post so that said handles can be guided to move up and down along said spaces.

* * * * *